US007052327B2

(12) United States Patent
Ko

(10) Patent No.: US 7,052,327 B2
(45) Date of Patent: May 30, 2006

(54) MICRO COAXIAL CABLE CONNECTOR ASSEMBLY AND METHOD OF ASSEMBLING THE SAME

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/895,877

(22) Filed: Jul. 20, 2004

(65) Prior Publication Data

US 2006/0019529 A1 Jan. 26, 2006

(51) Int. Cl.
*H01R 24/00* (2006.01)

(52) U.S. Cl. ..... 439/660; 439/733.1

(58) Field of Classification Search ..... 439/353, 439/354, 942, 668, 676, 693, 692, 682, 660, 439/733.1, 357, 358

See application file for complete search history.

(56) References Cited

U.S. PATENT DOCUMENTS 5,413,506 A * 5/1995 Thompson ..... 439/660
6,276,943 B1 * 8/2001 Boutros et al. ..... 439/676
D456,779 S 5/2002 Igarashi
6,616,473 B1 9/2003 Kamata
6,619,985 B1 9/2003 Ko
D482,660 S 11/2003 Hisamatsu
6,648,668 B1 11/2003 Ko
6,659,791 B1 12/2003 Ko
2004/0023548 A1 * 2/2004 Noro ..... 439/353

* cited by examiner

*Primary Examiner*—Tho D. Ta
*Assistant Examiner*—Felix O. Figueroa
(74) *Attorney, Agent, or Firm*—Wei Te Chung

(57) ABSTRACT

A method for assembling a micro coaxial connector assembly comprises the steps of providing an insulative housing having a base portion and a mating portion, providing a plurality of passageways in the base portion and a plurality of slots in the mating portion each terminating to a close end, providing a plurality of contacts having a mounting section and a mating section with a fastening tip downwardly curved, providing a cable having a plurality of wires each electrically connected to the mounting section of the contact, inserting the contacts into the slots through the passageways with the fastening tips of the contacts emplaced in the close end, providing a shield partially enclosing the housing with the mating section extending beyond the shield, and providing a pair of latch devices each partially enclosing the guiding portion.

3 Claims, 9 Drawing Sheets

MICRO COAXIAL CABLE CONNECTOR ASSEMBLY AND METHOD OF ASSEMBLING THE SAME

BACKGROUND OF THE INVENTION

1. Field of the Invention

The present invention relates generally to an electrical connector assembly and a method of assembling the same, and more particularly to a micro coaxial connector used in liquid crystal display (LCD) application and method of assembling the same.

2. Description of the Prior Art

An electronic apparatus such as a notebook computer may be provided with a liquid crystal display (LCD). In order to connect the liquid crystal display, use is made of various types of connectors. Micro coaxial cable connectors are widely used in this field due to the excellent preventing EMI (Electromagnetic Interference) function, stable electrical properties and high bending durability. U.S. Pat. Nos. 6,659,791 B1, 6,648,668 B1, 6,619,985 B1, D456,779 S and D482,660 S each disclose low profiled micro coaxial cable connector used for connecting with complementary connector on a motherboard in a notebook computer and the LCD panel of the notebook computer through a cable for transmitting signals therebetween.

Referring to FIGS. 7 and 8, a conventional micro coaxial connector generally comprises an insulative housing 700 having a base portion 705 and a mating portion 710 extending from the base portion 705, and defining a plurality of flat grooves 720 extending to a front surface of the mating portion 710, contacts 800 having mating sections 810 for inserting into the grooves 720 and a shield 900 partially enclosing the housing 400 except the mating portion 710. However, front ends of the mating sections 810 are aligned with the front surface of the housing 400 and are exposed outside thereat which are easily bent by an unexpected upward force when mating with a complementary connector, which possibly results in failure of signal transmission.

To prevent the deformation of the contacts, a process called "coin" is needed in art during manufacture, which means pressing the front ends of the contacts downwardly for securely engaging with the housing by a special tool. However, this coin process is very difficult to be completed because it requires highly accuracy between the tool and the contacts and easily damages the housing. Furthermore, only three to five contacts may be pressed down once, therefore repeated and continuous coin processes are needed for one connector having a plurality of contacts, which results in high cost and wasting of time.

Hence, in this art, an improved micro coaxial cable connector assembly and the method to overcome the above-mentioned disadvantages of the prior art will be described in detail in the following embodiments.

BRIEF SUMMARY OF THE INVENTION

A primary object, therefore, of the present invention is to provide a micro coaxial connector assembly having securely engagement between contacts and housing.

Another object, therefore, of the present invention is to provide a simplified method for assembling the micro coaxial connector assembly.

In order to implement the above object and overcomes the above-identified deficiencies in the prior art, the micro coaxial connector assembly in accordance with the present invention comprises an insulative housing, a plurality of contacts, a cable and a shield. The housing comprises a base portion and a mating portion extending from the base portion and provided with a plurality of slots with a closed end. The contacts each comprise a mounting section and a mating section with a fastening tip partially emplaced in the closed end and the mating section substantially projecting over a mating surface of the mating portion. The cable has a plurality of wires each electrically connected to the mounting section of the contact. The shield partially encloses the insulative housing with the mating section extending beyond.

The method for assembling the micro coaxial connector assembly comprises the steps of providing an insulative housing having a base portion and a mating portion, providing a plurality of passageways in the base portion and a plurality of slots in the mating portion each terminating to a closed end, providing a plurality of contacts having a mounting section and a mating section with a fastening tip downwardly curved, providing a cable having a plurality of wires each electrically connected to the mounting section of the contact, inserting the contacts into the slots through the passageways with the fastening tips of the contacts emplaced in the closed end, providing a shield partially enclosing the housing with the mating section extending beyond the shield, and providing a pair of latch devices each partially enclosing the guiding portion.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
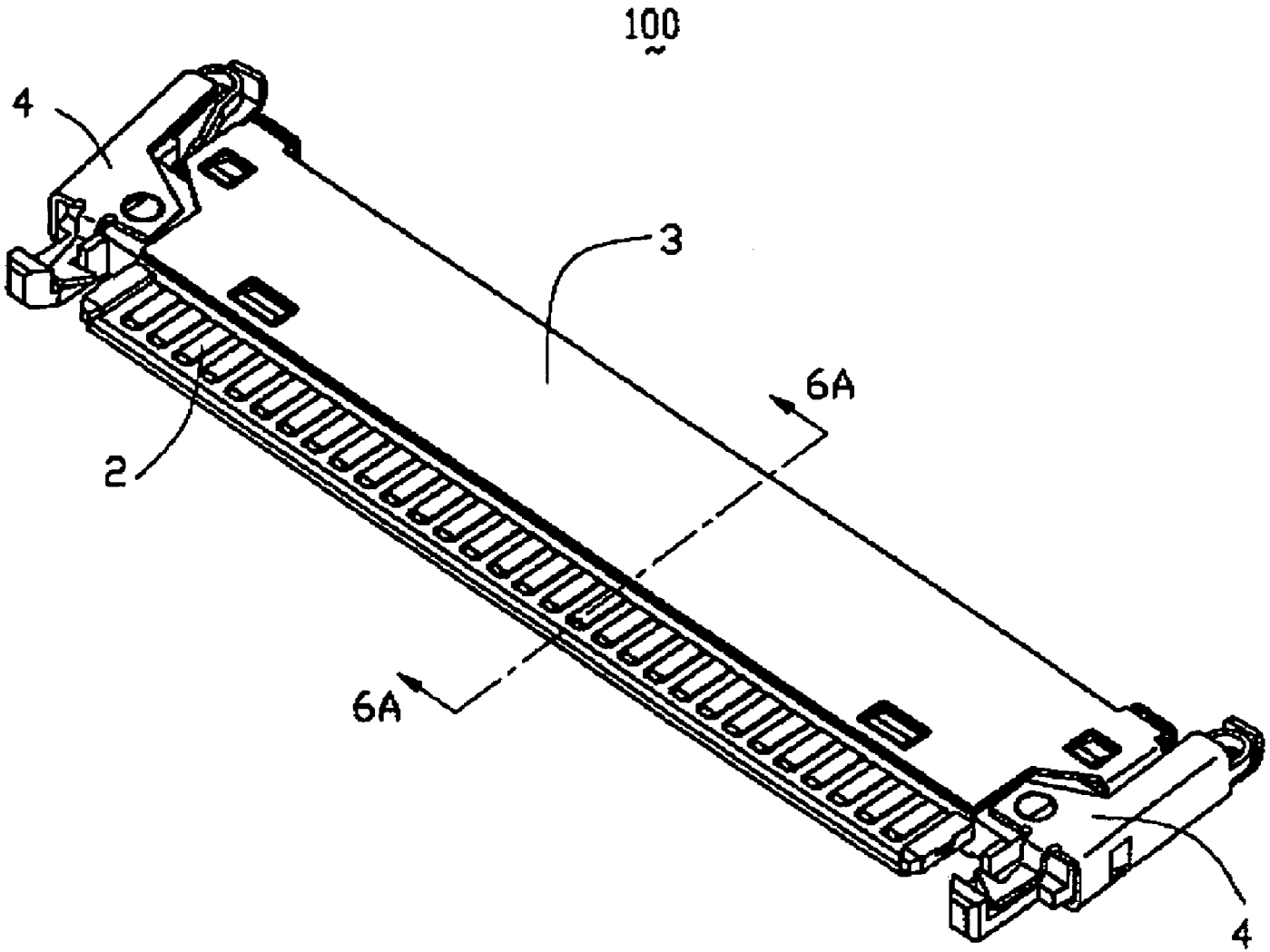
FIG. 1 is a perspective view from a top aspect view of a micro coaxial connector of a micro coaxial connector assembly in accordance with the present invention.
Figure 2:
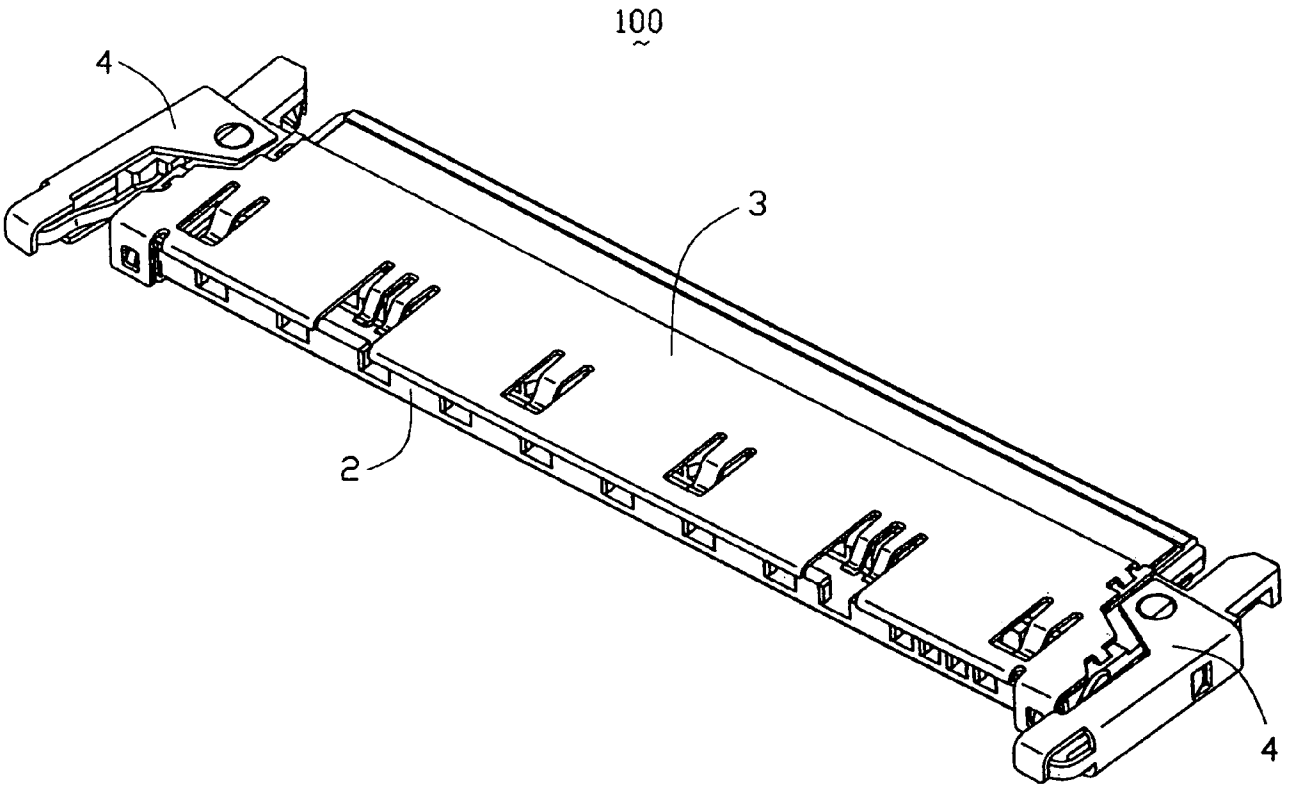
FIG. 2 is a perspective view from a bottom aspect view of the micro coaxial connector.
Figure 3:
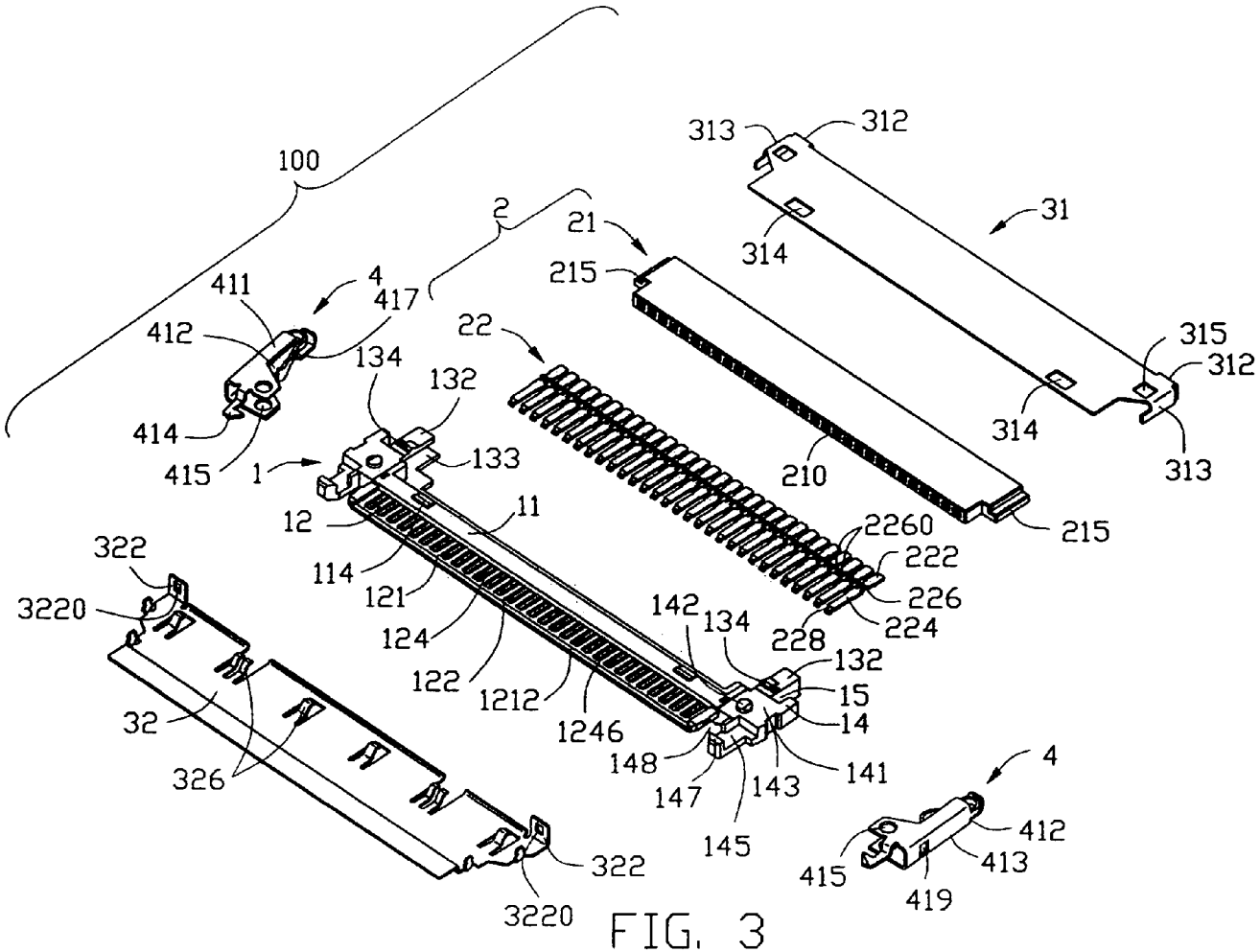
FIG. 3 is an exploded view of the micro coaxial connector.
Figure 4:
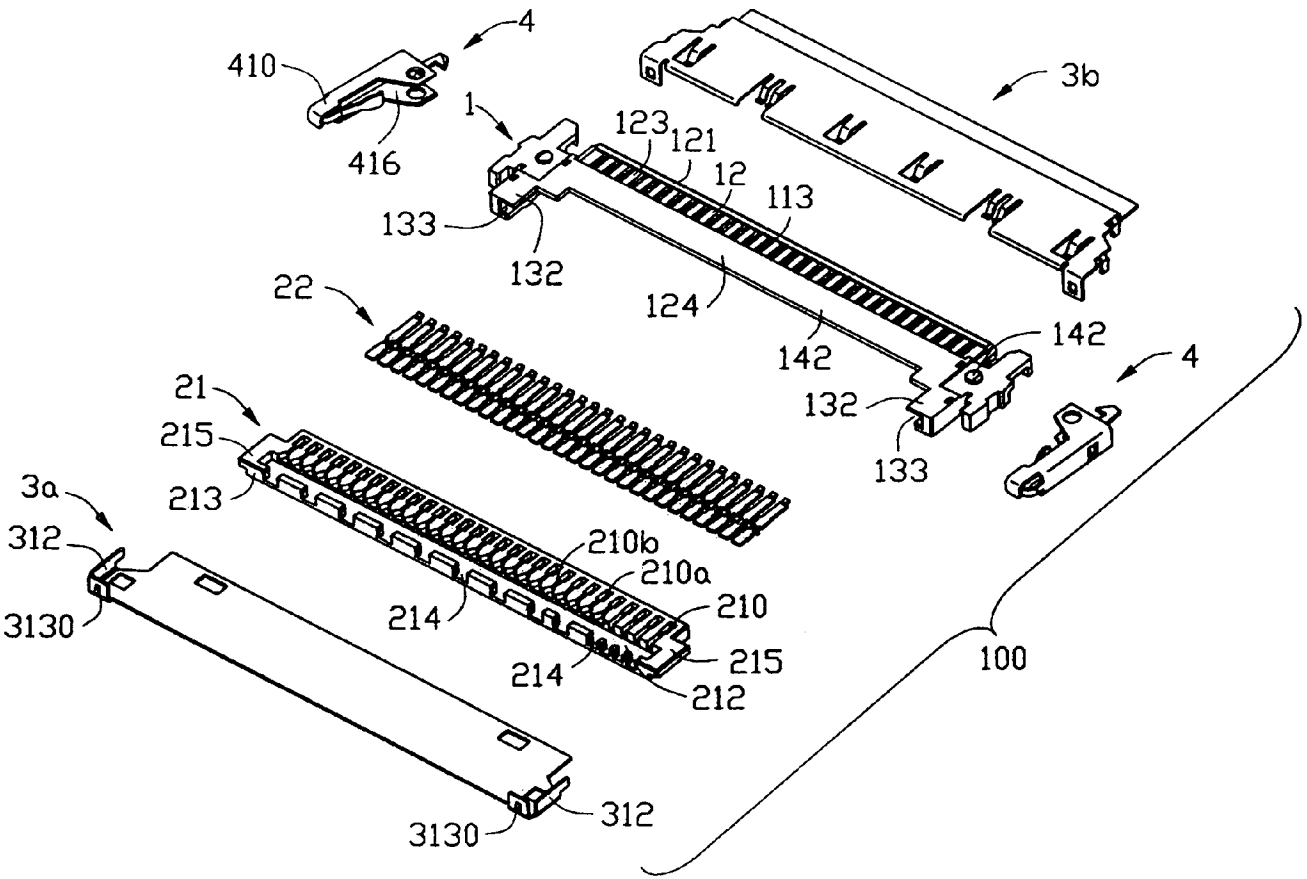
FIG. 4 is another exploded view of the micro coaxial connector.
Figure 5:
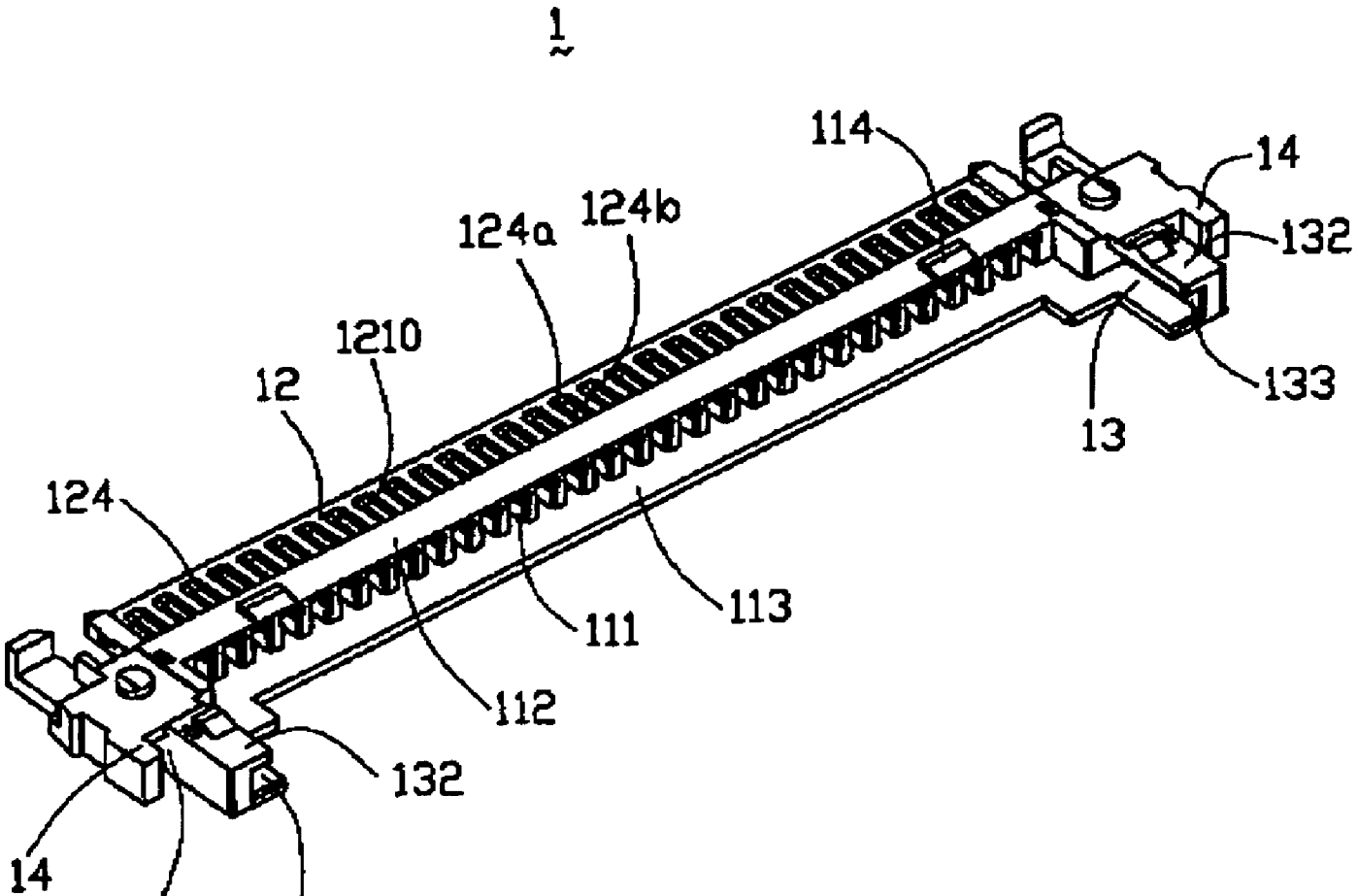
FIG. 5 is a perspective view of a housing of the micro coaxial connector.
Figure 6:
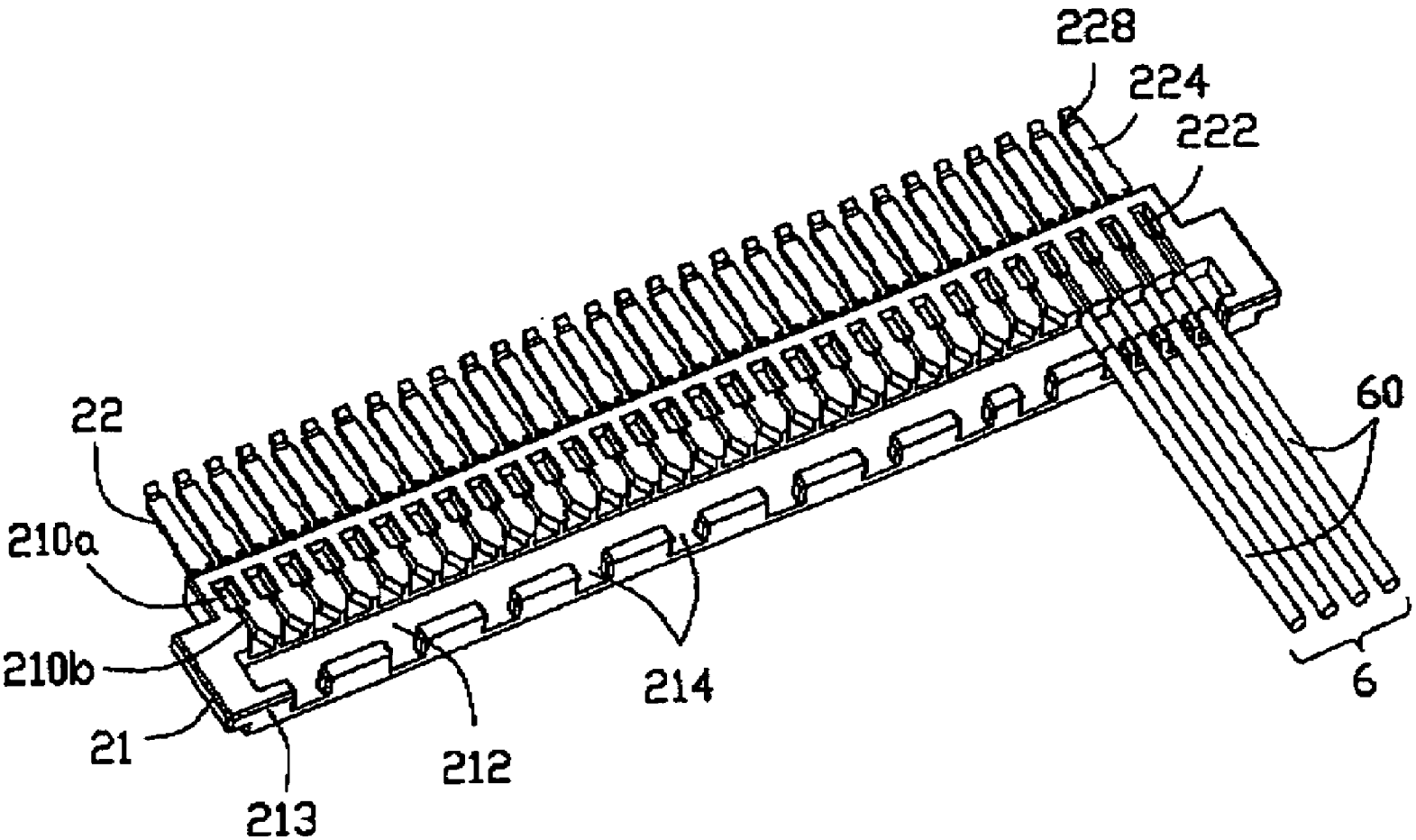
FIG. 6 is a perspective view of the micro coaxial connector assembly, showing the micro coaxial connector electrically connected with a cable.

Referring to FIGS. 1 to 4, a micro coaxial connector assembly in accordance with the present invention comprises a micro coaxial connector 100 and a cable 6 (FIG. 6). The micro coaxial connector 100 comprises an elongated insulative housing 1, a contact set 2, a shield 3 and a pair of latch devices 4.

Figure 6A:
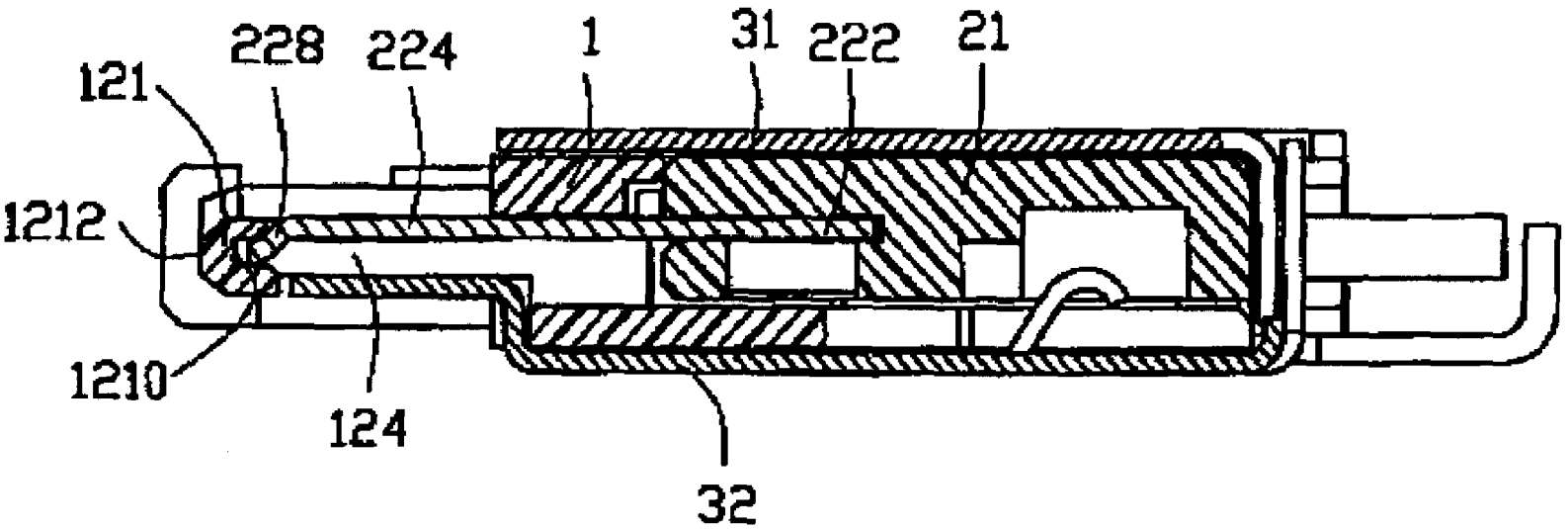
FIG. 6A is a cross-sectional view of the micro coaxial; connector assembly taken along line 6A—6A of FIG 1.
Figure 7:
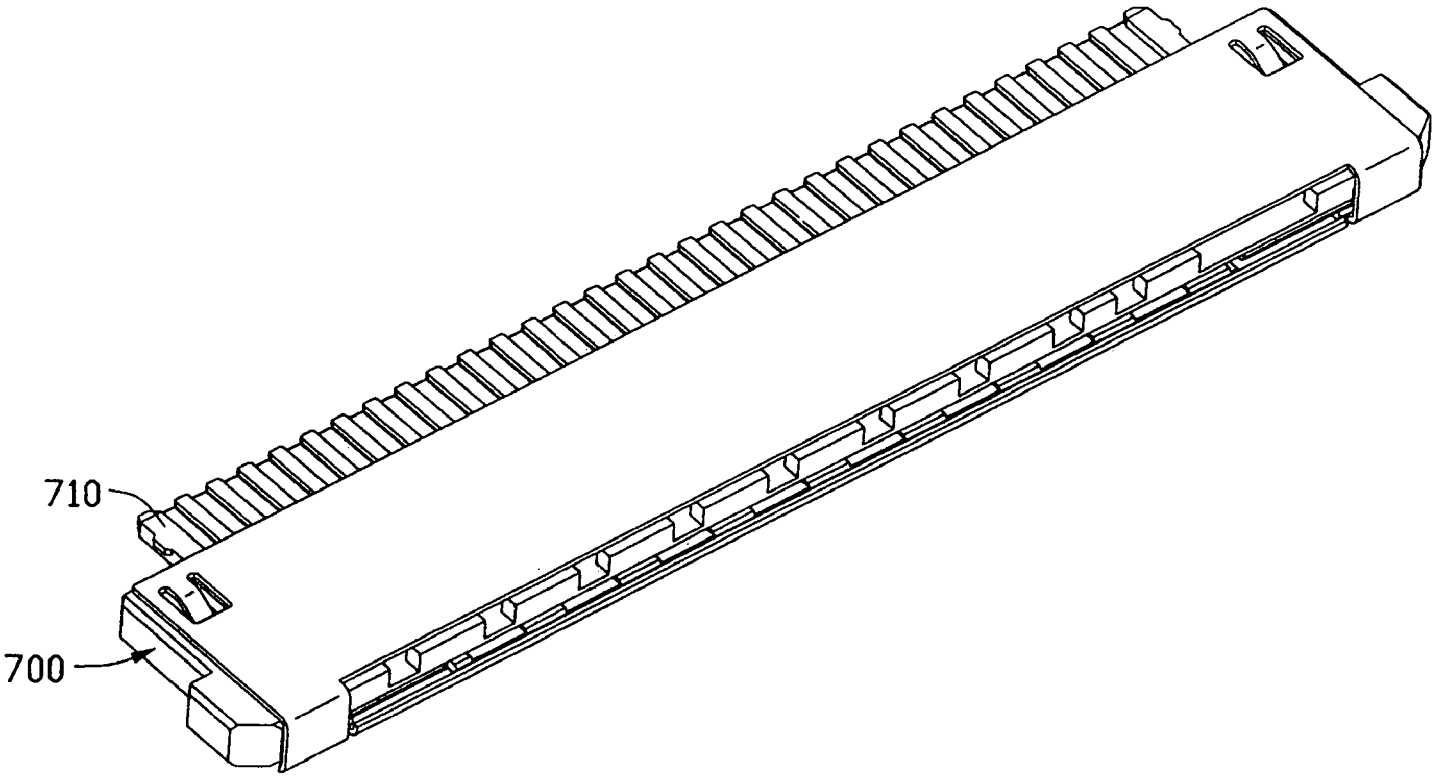
FIG. 7 (PRIOR ART)
FIG. 7 is a perspective view of a conventional micro coaxial connector.
Figure 8:
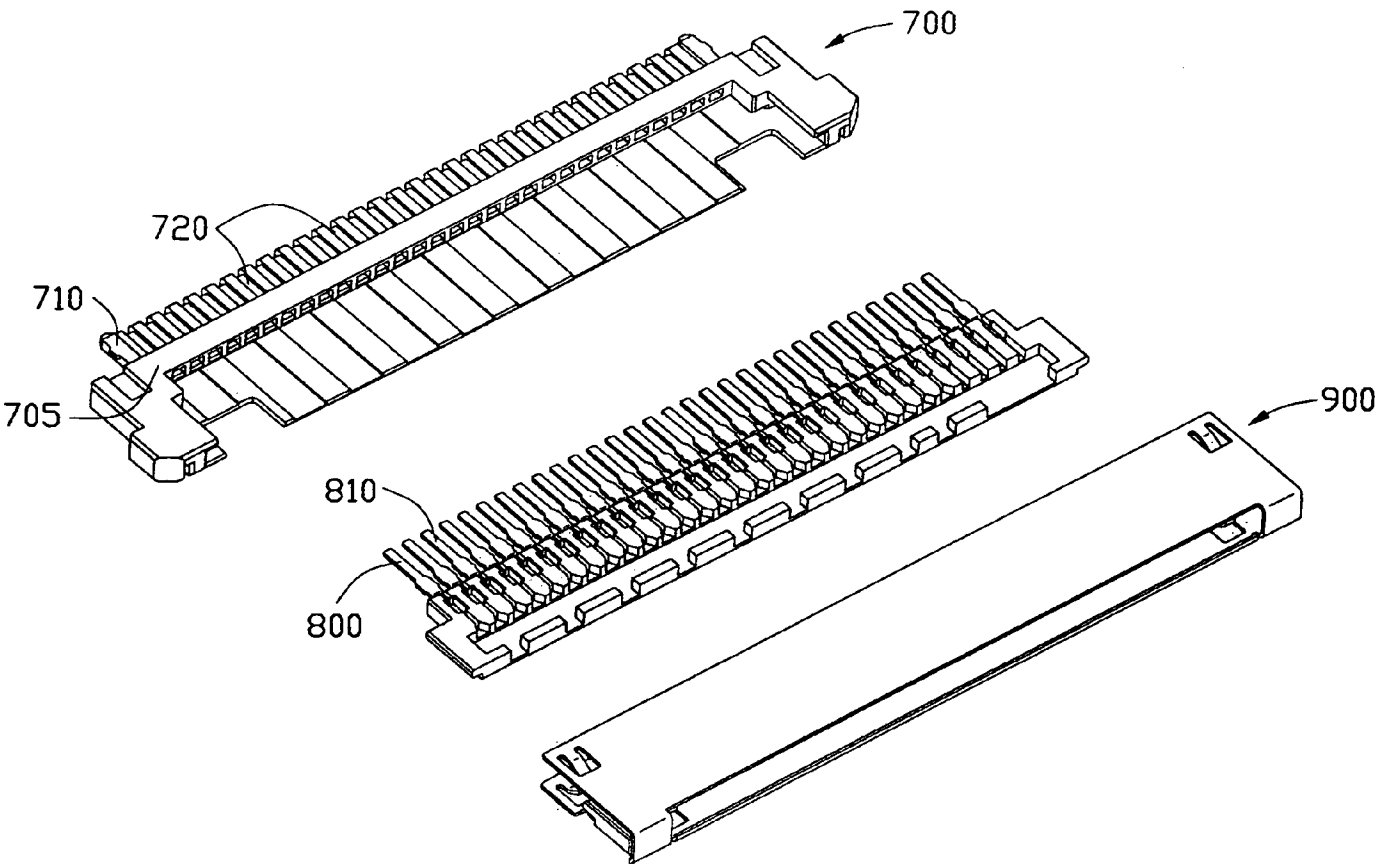
FIG. 8 (PRIOR ART)
FIG. 8 is an exploded view of the prior art micro coaxial cable connector of FIG. 7.

Referring to FIGS. 3–6 in conjunction with FIG. 6A, the insulative housing 1 comprises a base portion 11, a mating portion 12 extending forwardly from the base portion 11, a pair of receiving portions 13 and a pair of retention portions 14 formed on opposite transverse ends of the base portion 11. The base portion 11 comprises parallel top wall 112 and bottom wall 113. A plurality of protrusions 114 are formed on the top wall 112. The base portion 11 further defines a plurality of passageways 111 therethrough. The mating portion 12 comprises a mating surface 122, a bottom surface 123 and a closed end 121 having a front surface 1212 and a rear surface 1210, and defines a plurality of slots 124 communicating with the passageways 111 of the base portion 11 and extending into the closed end 121 of the mating portion 12. The slots 124 penetrate through the mating portion 12 from the mating surface 122 to the bottom surface 123. Each slot 124 is step-shaped and comprises a wider slot section 124*a* communicating to the top surface 122 of the mating portion 12 and a narrower slot section 124*b* communicating to the bottom surface 123 of the mating portion 12. The receiving portions 13 are formed on transverse ends of the bottom wall 113 and each define a receiving recess 133 in an inner side thereof and comprise a protuberance 134 for mating with the shield 3. Each retention portion 14 comprises a body portion 141 defining a depression 143 in an outer wall thereof, a guiding portion 145 extending forwardly from the retention portions 14 and having an upright end 147 at front end thereof for facilitating a mating of a complementary connector (not shown) with the micro coaxial cable connector 100, and two retention posts 142 formed on upper and lower surfaces of the retention portion 14 for facilitating mounting of the latch devices 4 onto the retention portions 14. Each retention portion 14 and the corresponding receiving portion 132 define a gap 15 therebetween. Each guiding portion 145 is distant from the mating portion 12. The guiding portions 145 and the mating portion 12 corporately define a pair of detached cavities 148 therebetween.

The contact set 2 comprises an insulative insert 21 and a plurality of contacts 22.

The insulative insert 21 defines a plurality of channels 210 adjacent to a front end thereof, a groove 212 adjacent to a rear end thereof and a plurality of openings 214 extending through a rear face 213 of the insert 21. The groove 212 is transversely extended. The openings 214 are provided for allowing a cable 6 (FIG. 6) having a plurality of wires 60 to extend into the groove 212 and the channels 210. The channels 210 each comprise a wider contact channel 210*a* for receiving a corresponding contact 22 and a narrower wire channel 210*b* for receiving a corresponding cable 6. The insert 21 further comprises a pair of insertion wings 215 at transverse ends thereof.

The contacts 22 have the same structure and each comprise a flat mounting section 222 for electrically connecting with a corresponding cable 6 and having a pair of spines outwardly protruding therefrom for locking with the insert 21, a mating section 224 for electrically mating with the complementary connector and having a fastening tip 228 downwardly curved from a front end of the mating section 224 for securely fastening with the housing 1, and a connecting section 226 connecting the mounting section 222 and the mating section 224 and having two protuberances 2260 upwardly extending therefrom for blocking the mating section 224 entering into the insert 21.

The shield 3 comprises an upper plate 31 and a lower plate 32. The upper plate 31 comprises a pair of side bars 312 and upper flanges 313 extending downwardly from a rear edge thereof and having resilient bulges 3130 thereon, and defines a plurality of front apertures 314 and side apertures 315. The lower plate 32 comprises a pair of lower flanges 322 extending upwardly from a rear edge thereof and defining pinholes 3220 for receiving the resilient bulges 3130 and a plurality of resilient tabs 326 upwardly extending from a middle region of the lower plate 32.

Each latch device 4 comprises a U-shaped main body 410 and a hook 414 in a configuration of a claw extending rearwardly from the body 410. The body 410 comprises a top portion 411, a bottom portion 412 and a side portion 413 connecting side edges of the top and the bottom portions 411, 412. The top portion 411, the bottom portion 412 and the side portion 413 together define a receiving space 416. The hook 414 extends through the detached cavity 148 when the latch device 4 is mounted on a corresponding retention portion 14. Two retaining holes 415 are defined through the top and bottom portions 411, 412 of the body portion 410. A spring tab 417 extends forwardly from a rear end of the side portion 413 and in a direction away from an inner surface of the side portion 413. An engaging tab 419 is formed by the side portion 413 and extends inwardly for engaging in the depression 143 defined in the outer wall of the corresponding retention portion 14.

Again referring to FIGS. 1–6 in conjunction with FIG. 6A, in assembly, the contacts 22 with fastening tips 228 downwardly curved, the insert 21, the insulative housing 1 and the shield 3 are respectively prepared at first.

The contacts 22 are respectively inserted into the channels 210 of the insert 21 with the mounting section 222 of the contacts 22 received in the contact channels 210*a* and the mating sections 224 extending forwardly beyond the insert 21 and blocked outside the insert 21 by the protuberances 2260 to form a contact set 2, wherein the connecting sections 226 have an interferential fit with the rear insert 21.

A cable 6 having a plurality of wires 60 is placed in the wire channels 210*b* of the insert 21 with inner conductors (not shown) electrically connected with the corresponding mounting sections 222 of the contact 22, respectively.

The contact set 2 is then assembled into the housing 1 by the insertion wings 215 of the insert 21 inserting into the receiving recess 133 of the receiving portions 132 and the mating sections 224 of the contacts 22 inserting into the slots 124 through the passageways 11.1 respectively. With the insertion of the contact set 2, the mating sections 224 are partially received in the wider slot sections 124*a* and substantially project over the mating surface 122 of the mating portion 12, and the fastening tips 228 are received in the narrower slot section 124*b* and emplaced in the closed end 121.

The shield 3 is then assembled onto the housing 1. The upper plate 31 is assembled with the plurality of protrusions 114 fitted into the front apertures 314, the protuberances 134 fitted into the side apertures 315, and the side bars 312 engaging in the gaps 15 of the retention portions 14. The lower plate 32 is assembled with the resilient tabs 326 extending into the receiving groove 212. The upper plate 31 and the lower plate 32 are fixed together by the resilient bulges 3130 on the flanges 313 of the upper plate 31 engaging with the pinholes 3220 defined in the rear portions 322 of the lower plate 32.

The latch devices 4 are finally respectively assembled to the retention portions 14 of the housing 1 from transverse outside of the housing 1 to a position wherein the retention portions 14 are respectively inserted into the receiving spaces 416 of the body portions 410. The retention posts 142 are fitted into the retaining holes 415 so that the latch devices 4 are pivotably mounted on the retention portions 14, respectively. The spring tabs 417 extend into the gaps 15 and resiliently abut against the side bars 312 of the upper shield 31 so that the latch devices 4 and the shield 3 are electrically connected together. The engaging tabs 419 engage in the depressions 143 to more stably mount the latch devices 4 to the retention portions 14. Accordingly, assembly of the micro coaxial cable connector assembly in accordance with the present invention is completed.

It is to be understood, however, that even though numerous characteristics and advantages of the present invention have been set forth in the foregoing description, together with details of the structure and function of the invention, the disclosure is illustrative only, and changes may be made in demounting, especially in matters of shape, size, and arrangement of parts within the principles of the invention to the full extent indicated by the broad general meaning of the terms in which the appended claims are expressed.

What is claim is:

1. A method for assembling an electrical connector assembly, comprising the steps of:

providing an insulative housing having a base portion and a mating portion extending therefrom;

providing a plurality of slots in the mating portion each terminating to a closed end;

providing a plurality of passageways in the base portion, each passageway communicating with a slot;

providing a plurality of contacts;

providing a cable having a plurality of wires each electrically connected to the contact;

inserting the contacts into an insulative insert, the insert defining a plurality of channels, mounting sections of the contacts being received in channels;

providing a groove in the insert and providing a plurality of resilient tabs on the shield, the tabs being received in the groove;

inserting the contacts into the slots through the passageways with an end of the contact emplaced in the closed end;

providing a pair of guiding portions each formed on a transverse side of the housing; and providing a pair of latch devices each partially enclosing the guiding portion.

2. The method for assembling an electrical connector assembly as claimed in claim 1, wherein the step of providing a pair of guiding portions further comprises forming an upright end on the guiding portions.

3. An electrical connector assembly, comprising:

an insulative housing having a base portion and a mating portion extending therefrom, the mating portion defining a plurality of slots with a closed end;

a plurality of contacts received in the slots, each contact having a mounting section and a mating section with a fastening tip partially emplaced in the closed end, the matins section substantially projecting over a mating surface of the mating portion;

a cable having a plurality of wires each electrically connected to the mounting section of the contact;

a shield partially enclosing the insulative housing with the mating section extending beyond the shield; and a pair of guiding portions each formed on a lateral side of the housing, and each provided with a latch device partially enclosing the guiding portion, wherein the slots of the housing penetrate through the mating portion from the mating surface to a bottom surface; and wherein the slots are step-shaped and each comprise a wider slot section exposed to the mating surface of the housing and partially receiving the mating sections of the contacts, and a narrower slot section exposed to the bottom surface of the housing and partially receiving the fastening tips of the contacts.

* * * * *